United States Patent [19]

Broussard

[11] Patent Number: 4,756,526

[45] Date of Patent: Jul. 12, 1988

[54] EXERCISE DEVICE

[75] Inventor: Robert Broussard, Los Angeles, Calif.

[73] Assignee: Progressive Health and Fitness, Los Angeles, Calif.

[21] Appl. No.: 830,955

[22] Filed: Feb. 19, 1986

[51] Int. Cl.[4] ..... A63B 13/00

[52] U.S. Cl. ..... 272/123; 272/117

[58] Field of Search ..... 272/67, 116, 117, 118, 272/119, 122, 123, 124, 127, 128, 143; D21/191, 197

[56] References Cited

U.S. PATENT DOCUMENTS

| | | | |
|---|---|---|---|
| 460,270 | 9/1881 | Somerby . | |
| 793,101 | 6/1905 | Schmidt . | |
| 2,676,802 | 4/1954 | O'Brien | 272/84 |
| 3,120,954 | 2/1964 | Apostol | 272/117 |
| 3,226,117 | 12/1965 | Walklet | 272/123 |
| 3,482,835 | 12/1969 | Dean | 272/84 |
| 3,756,597 | 9/1973 | Monti | 272/81 |
| 3,781,007 | 12/1973 | Baker | 272/84 |
| 3,904,198 | 9/1975 | Jones | 272/81 |
| 4,010,947 | 3/1977 | Lambert, Sr. | 272/118 |
| 4,103,887 | 8/1978 | Shoofler | 272/123 |
| 4,231,569 | 11/1980 | Rae | 272/122 |
| 4,312,506 | 1/1982 | Brennan | 272/123 |
| 4,327,908 | 5/1982 | James | 272/119 |
| 4,369,968 | 1/1983 | Price | 272/123 |
| 4,377,282 | 3/1983 | Hayes | 272/124 |
| 4,538,805 | 9/1985 | Parviainen | 272/117 X |
| 4,607,840 | 8/1986 | Harper | 272/117 |
| 4,673,179 | 6/1987 | Pengler | 272/122 |
| 4,681,315 | 7/1987 | Yang | 272/143 |

FOREIGN PATENT DOCUMENTS

| | | | |
|---|---|---|---|
| 21900 | 11/1903 | United Kingdom | 272/122 |

*Primary Examiner*—Richard J. Apley
*Assistant Examiner*—Robert D. Bahr
*Attorney, Agent, or Firm*—Ashen Golant Martin & Seldon

[57] ABSTRACT

An exercise device comprising a pair of weight plates (10) is disclosed which can be mounted for rotation about a lifting bar (22) with the plates' centers of gravity below the lifting bar. A leverage control bar, coupled to the plates for rotation therewith, is positioned to contact the users forearm during a portion of the curling movement, thereby limiting the rotation of the plates and maintaining the plates' centers of gravity in a lagging position with respect to the user's hands so as to exert relatively constant resistance during the movement.

9 Claims, 2 Drawing Sheets

EXERCISE DEVICE

BACKGROUND OF THE INVENTION

The present invention relates to exercising apparatus of the weight lifting type. These types of devices are well known in the art and typically employ such means as one or more weight plates which are lifted by means of a lifting bar. They are commonly referred to as dumb-bells, bar bells, and/or free weights. As used herein, all three terms shall be deemed equivalent.

The present invention is more specifically related to variable resistance exercise devices which compensate for changes in body leverage during an exercise movement. Such leverage changes are caused by the lever effect that a straight line muscle contraction has upon a body part that rotates about a joint.

One limitation associated with the use of barbells as been the loss in resistance that is encountered as the weight approaches a point directly over or under the axis of rotation. In a bicep curl, for example, the substantial portion of the weight is borne by the skeletal structure when the weight is over the elbow. As the curl movement is continued toward the body, the weight actually pulls the arm in the direction of travel.

The search for an exercise device which provides a relatively constant resistance throughout the exercise movement has been substantial. Owing to both leverage changes during the movement, and to the loss in resistance as the weight approaches the aforedescribed position, those skilled in the art have assumed that the barbell has inherently limited utility.

Accordingly, there has been an emphasis recently on expensive and complex equipment utilizing cams or fluid pressure to provide relatively constant resistance and a "smooth" feeling to facilitates maximum stressing of the muscle throughout the exercise movement. However, such equipment has its own limitations in that they work the major muscle groups but ignore the minor muscle groups by restricting movement to a pre-defined arc and eliminating the need to balance the weights during the exercise movement. Additionally, the predefined arc may not match the natural movement of the user.

U.S. Pat. No. 4,231,569 discloses an exercising frame having one end portion which is gripped by the user, a second end portion longitudinally spaced from the first end along a longitudinally extending frame axis and to which a pair of weights are attached, and an intermediate portion therebetween. A handle is rotatably attached to said forst end for rotation of the frame about an axis which is transverse to the frame axis. The intermediate portion contains an arm-engaging surface which keeps the weight from reaching a point above the elbow during the curling movement.

While the device disclosed in the forgoing patent provides resistance througout a curling movement, it does not compensate for changes in body leverage. Additionally, it represents an extra piece of equipment.

SUMARY OF THE INVENTION

The present invention is directed to an exercise device which can be used both as a conventional barbell and an improved bar bell wherein relatively constant resistance during an exercise movement provided and changes in body leverage are generally compensated for.

The exercise apparatus disclosed herein comprises weight plate means for providing a movable weight-training mass and having a center of mass. A generally cylindrical lifting bar extends generally longitudinally from the weight plate means and is coupled for rotation with respect thereto at a position offset from said center of mass. A leverage bar extends generally longitudinally from the weight plate means and is coupled thereto for rotation therewith, the leverage bar being positioned to rotate with the weight plate means about the lifting bar so as to contact the outer lower arm of a user after the weight plate means is lifted by the lifting bar.

Weight plate means are provided in the form of a mass of material which including mounting means located at an offset position from the plate's center of gravity for mounting the weight to a lifting bar, and second means positioned on the plate for coupling to a second bar. In the preferred embodiement, the mounting means and second coupling means are simply a pair of aperatures which are sized to receive the lifting bar and leverage bar, respectively.

Further advantages and features of the invention will be more fully apparent to those skilled in the art from the following detailed description of the preferred embodiment, of which the following Drawing is a part.

DESCRIPTION OF THE PREFERRED EMBODIMENT

Figure 1:
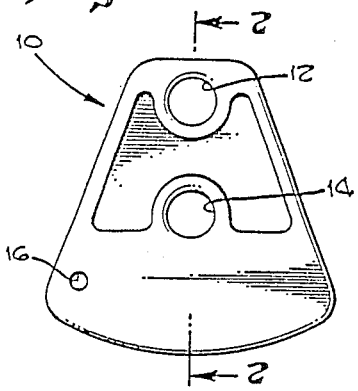
FIG. 1 is a side elevation view of a weight plate constructed in accordance with the invention.
Figure 2:
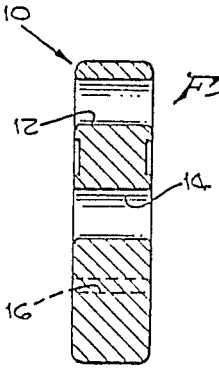
FIG. 2 is a cross section of the weight plate of FIG. 1 taken along line 2—2.

FIG. 1 is a front elevation view of a weight plate 10 constructed in accordance with the invention, while FIG. 2 is a cross-sectional view of the weight plate taken along line 2—2 in FIG. 1. The weight plate 10 is formed from a mass of material symmetrically disposed about an axis of symmetry which is co-extensive with line 2—2. The plate is preferably in the shape of a truncated isosceles triangle having a rounded base and corners.

The weight 10 has three apertures 12, 14, 16. Aperture 14 is located at the weight's center of gravity and, as will be discussed below, is sized to mount for rotational movement about a lifting bar.

Aperture 12 is located on the axis of symmetry 2—2, and at a position which is offset from the weight's center of gravity and is also sized to mount for rotational movement around a lifting bar. The aperture 12 is preferably positioned near the top of the weight so that substantially all the weight of the plate 10 will hang below the lifting bar when the aperture 12 is used to mount the plate.

Aperture 16 is located on the side of the plate's center of gravity which is opposite aperature 12. For reasons which will explained, the aperture 16 is located remote from the plate's axis of symmetry 2—2, preferably adjacent one of the lower corners of the plate.

Figure 3:
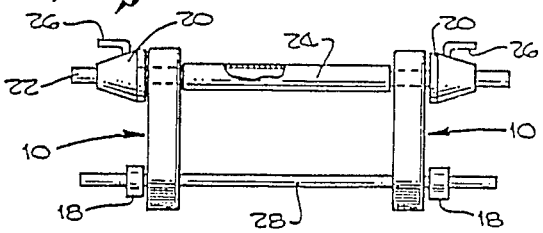
FIG. 3 is a front elevation view of an exercise device constructed in accordance with the invention.
Figure 6:
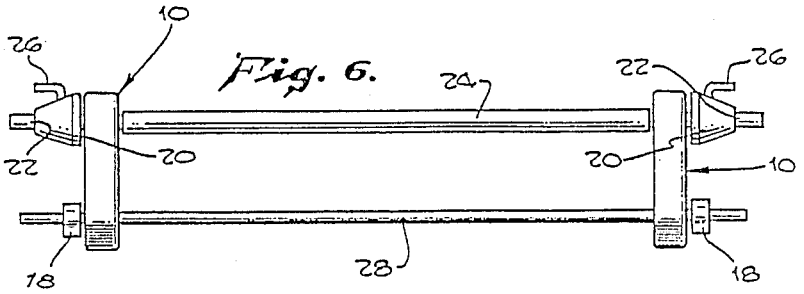
FIG. 6 is a front elevation view of another exercise device constructed in accordance with the invention.

FIG. 3 is a front elevation view of an exercise device constructed in accordance with the invention and used for one-handed exercises, while FIG. 6 is a similar view of an exercise device used for two-handed lifting whrein similar components have been identified with like numerals. The exercise device in FIG. 3 comprises a pair of longitudinally-spaced weight plates 10 mounted on opposite end portions of a lifting bar 22 which extend longitudinally therebetween. The lifting bar 22 is slidably received by the aperture 12 (FIG. 1) of each plate, so that the substantial portion of the plates' weight is below the lifting bar 22 when the device is lifted by the bar 22.

The plates may be conveniently secured to the lifting bar 22 by such means as conventional collars 20 which have set screws 26 that tighten against the lifting bar. The plates, because of their shape, are stable when set down on the floor. By contrast, conventional round weights will roll, creating a risk of damage or injury.

A leverage bar 28 extends longitudinally between the plates 10 and passes through the apertures 16 (FIG. 1) of the plates. A pair of retaining collars 18 are respectively mounted on the opposite ends of the leverage bar to prevent the bar from slipping out of the plates.

Figure 4:
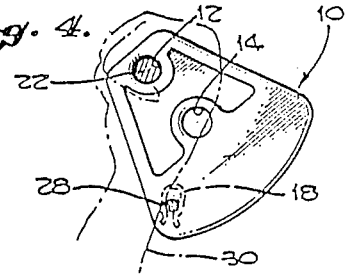
FIG. 4 is a side elevation view depicting one use of an exercise device constructed in accordance with the invention.

FIG. 4 depicts the exercise device being used in a curling or fly movement, with the lifting bar mounted in aperture 12 (FIG. 1). As evident from the illustrated hand, the Figure shows the device near the upper end of the movement. Returning momentarily to FIG. 1, it may be appreciated that the plates will tend to retain the illustrated orientation during the movement if the plate is symetrical on both sides of line 2—2. Specifically, each plate's center of gravity will seek to hang directly under the center of the aperture 12 throughout the curl or fly movement. Accordingly, the plates 10 rotate about the lifting bar to retain their orientation as the device is lifted along the acruate path of the curl or fly.

An outer tubular cover 24 circumventing the lift bar 22 may be provided between the weights. The tubular cover 22 is of slightly larger diameter than the lift bar, permitting the bar 22 to rotate with the plates 10 while the cover 24 is gripped by the user. Accordingly, the user's grip is undisturbed as the plates rotate about the bar 22.

As shown in FIG. 4, however, the leverage bar 28 extending between the plates prevents the plates 10 from rotating towards the user during the top portion of the movement. Because the leverage bar rotates with the plates about the lifting bar, it contacts the user's outer forearm 30 and prevents the plates from swinging inwardly towards the user. The plates' centers of gravity are accordingly held in a lagging position with respect to the user's hand, and thereby continue to exert a torque against the user's biceps.

Figure 5:
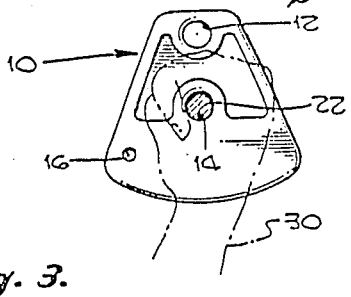
FIG. 5 is a side elevation view depicting another use of an exercise device constructed in accordance with the invention.

As shown in FIG. 5, the lifting bar 22 may also be mounted in aperture 14 at the plate's center of gravity, and the leverage bar 28 removed, thereby permitting the device to function as a conventional barbell.

Figure 7:
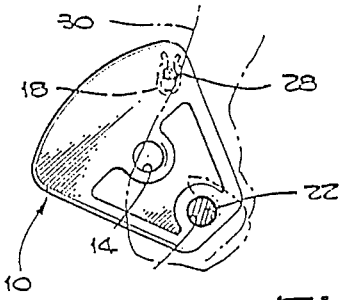
FIG. 7 is a side elevation view depicting another use of an exercise device constructed in accordance with the invention.

FIG. 7 shows the use of the exercise device in a lateral raise. The purpose of a lateral raise movement is to exercise the shoulder muscles. However, conventional barbells place a heavy strain on the user's grip and wrist and these muscles usually before the shoulders. As shown in FIG. 7, the user lifts the subject device by the lifting bar 22, and rotatingly flips the weights so that the leverage bar 28 rests on the outer forearm 30. As the device is raised laterally, the substantial portion of the plates' weight is supported by the user's forearm 30, thereby efficiently working the shoulder muscles.

While the foregoing description of the preferred embodiment is specific in its detail, it is recognized that variations and modifications may be made by those skilled in the art having the benefit of these teachings. It is therefore intended that the invention be defined by the appended claims and that the claims be interpreted as broadly as permitted by the prior art to include equivalent embodiments.

I claim:

1. An exercise apparatus comprising:

(a) a pair of longitudinally separated weight plates for providing a movable weight-training mass and having respective centers for gravity;

(b) a generally cylindrical lifting bar extending generally longitudinally between the weight plates and mounted thereto at first respective locations on the plates offset from said respective centers of gravity;

(c) means for permitting rotation of the weight plates about the lifting bar as the apparatus is moved by a user;

(d) a leverage bar extending generally longitudinally between the pair of weight plates and mounted thereto for rotation therewith at respective second locations on the weight plate means different from the respective first locations, the leverage bar being positioned to rotate with the weight plate means about the lifting bar so as to contact the outer forearm of the user during the exercise movement.

2. The exercise apparatus of claim 1 wherein the leverage bar extends from the longitudinally-spaced weight plates.

3. The exercise apparatus of claim 1 wherein the longitudinally separated weight plates rotatably receive the opposite end portions of the lifting bar.

4. The exercise apparatus of claim 1 wherein the opposing end portions of the leverage bar are received by the longitudinally-spaced weight plates.

5. The exercise apparatus of claim 1 wherein the weight plates each comprise a mass of material formed about an axis of symmetry, and includes first mounting means located at a first position offset from the plates center of gravity for mounting the weight plate to the lifting bar, and second means located at a second position on the plate for mounting the plate to the leverage bar at a position remote from said axis, the first and second positions being relatively positioned so that the shortest line connecting them does not pass through the plate's center of gravity.

6. The exercise apparatus of claim 1 wherein the weight plates each comprise a mass of material formed about an axis of symmetry, and includes a first aperture located at a first position offset from the plate's center of gravity for mounting the weight plate to the lifting bar, and a second aperture located at a second position on the plate for mounting the plate to the leverage bar at a position remote from the axis, the first and second positions being relatively positioned so that the shortest line connecting them does not pass through the plate's center of gravity.

7. The exercise apparatus of claim 1 wherein the weight plates each comprise a mass of material formed about an axis of symmetry, and includes a first aperture located at an offset position from the plate's center of gravity for receiving the lifting bar, and a second aperture positioned on the plate for receiving the leverage bar, at a position removed from the axis, the first and second apertures being relatively positioned so that the shortest line connecting them does not pass through the plate's center of gravity.

8. An exercise apparatus comprising:

(a) a generally longitudinally-extending lifting bar;

(b) at least one weight plate for providing a movable weight-training mass and having a center of gravity, the weight plate being mounted on the lifting bar at a first position offset from its center of gravity for pivotable movement about the lifting bar;

(c) a leverage bar mounted to the weight plate remote from the first position and from said center of gravity for rotation therewith, the leverage bar being positioned to rotate with the weight plate means about the lifting bar so as to contact the outer lower arm of a user during the exercise movement.

9. An exercise apparatus comprising:

(a) a generally longitudinally-extending lifting bar;

(b) a weight plate for providing a movable weight-training mass and having a center of gravity, the weight plate being mounted on the lifting bar at a position offset from its center of gravity;

(c) means for permitting rotational movement of the weight plate about the lifting bar; and (d) leverage bar means attached to the weight plate for rotation therewith, the leverage bar means being coupled to the weight plate at a position spaced from the position on the plate at which the lifting bar is mounted, the leverage bar means being positioned to rotate with the weight plate about the lifting bar so as to contact the outer lower are of a user after the weight plate means is lifted by the lifting bar.

* * * * *